United States Patent [19]

Miller

[11] 4,090,183

[45] May 16, 1978

[54] BILLFOLD ANTI-THEFT DEVICE

[75] Inventor: Joe Miller, East Orange, N.J.

[73] Assignee: Lawrence Peska Associates, Inc., New York, N.Y.

[21] Appl. No.: 793,837

[22] Filed: May 5, 1977

[51] Int. Cl.[2] ..... G08B 13/14

[52] U.S. Cl. ..... 340/280; 340/283

[58] Field of Search ..... 340/283, 280

[56] References Cited

U.S. PATENT DOCUMENTS

| | | | |
|---|---|---|---|
| 3,701,140 | 10/1972 | Dixon | 340/283 |
| 3,815,118 | 6/1974 | McDonald | 340/283 |
| 3,930,249 | 12/1975 | Steck et al. | 340/280 |
| 3,938,126 | 2/1976 | Ransom | 340/283 |
| 3,959,789 | 5/1976 | McGahee | 340/280 |

*Primary Examiner*—Glen R. Swann, III

*Attorney, Agent, or Firm*—Daniel H. Bobis

[57] ABSTRACT

A housing contains a battery-operated alarm and a spring clip to hold a billfold to the housing. A plate is removably attached to the housing and functions to hold open a switch in the alarm's circuit. If a thief attempts to steal the billfold, the housing is separated from the plate, allowing the switch to close and sound the alarm. A control lever allows the owner to release the billfold when he wishes to remove it from the spring clip.

5 Claims, 3 Drawing Figures

BILLFOLD ANTI-THEFT DEVICE

PRIOR ART

The following patents are considered pertinent: U.S. Pat. Nos.

2,797,405; 3,297,070; 3,462,801; 3,701,140; 3,815,118; 3,893,096; 3,930,249; 3,938,126.

BACKGROUND OF THE INVENTION

This invention relates to an anti-theft device for use with a billfold.

Thefts of billfolds from the owner have been a long felt problem. Skilled thieves can easily remove a billfold from the clothing of the owner without gaining the owner's attention. Thus, it would be highly desirable to provide a means for alerting the owner of the theft or attempted theft which can be carried by the owner and which is reliable for identifying the thief.

It is an object of this invention to provide an alarm for use with a billfold which can be carried by the owner.

It is a further object of this invention to provide an alarm which is reliable in identifying a theft and which permits the owner to remove the billfold without activating the alarm.

Further objects of this invention will be evident in view of the following detailed disclosure.

SUMMARY OF THE INVENTION

In accordance with this invention, an anti-theft device for billfolds is provided including an alarm and a housing for the alarm. The billfold is secured tightly to the housing in a manner so that the owner can release the billfold from the housing when desired but a thief not aware of the housing who attempts to steal the billfold is not able to detach the billfold from the housing. A plate provided with hooks is attached to the housing and is adapted to be released from the housing to activate the alarm when removed by a thief but is not activated by the billfold owner aware of the anti-theft device.

DETAILED DESCRIPTION OF THE PREFERRED EMBODIMENTS

Figure 1:
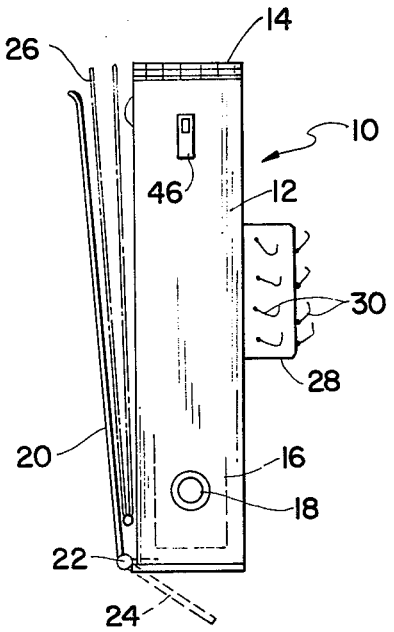
FIG. 1 is a side view of the apparatus of this invention.
Figure 2:
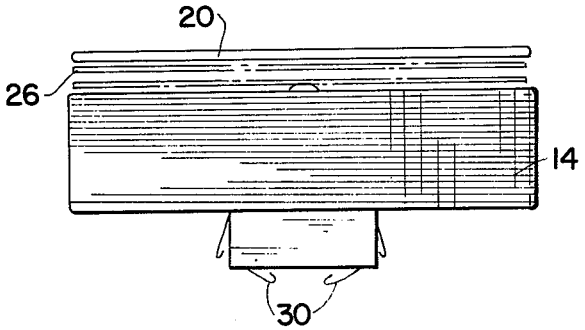
FIG. 2 is a top view of the apparatus of FIG. 1.

Referring to the drawings, the anti-theft device 10 includes a housing 12 for a conventional alarm including a speaker 14 and a housing 16 for a power source such as for batteries 18. A spring actuated clip 20 is attached to housing 12 by spring 22 and spring tension control lever 24 to secure billfold 26 to the outside surface of housing 12.

Figure 3:
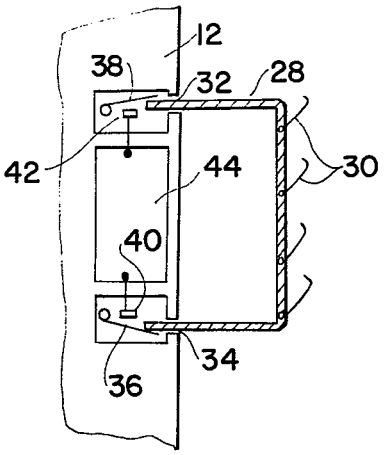
FIG. 3 is a partial cross-sectional view of the apparatus of FIG. 1.

A plate 28 is provided with hooks 30 adapted to be secured to the clothing of the billfold owner. As seen in FIG. 3, plate 28 fits into slots 32 and 34 of housing 12 and prevents spring loaded contacts 36 and 38 from contacting electrical contacts 40 and 42. When plate 28 is removed from housing 12, contacts 38 and 36 contact electrical contacts 40 and 42 which activate microswitch 44 to actuate the alarm which emits a sound through speaker 14.

When a thief attempts to remove the billfold 26 from the pocket of the owner without releasing control lever 24, the spring loaded clip 20 will retain the billfold 26 in contact with housing 12 and both the housing 12 and billfold 26 will be removed together. When this occurs, hooks 30 will attach to the clothing of the owner and cause the plate 28 to be removed from housing 12 so that contacts 38 and 36 will contact electrical contacts 42 and 40 to actuate the alarm. The owner of the billfold, knowing of the anti-theft device, will release control lever 24 prior to removing the billfold 26 so that clip 20 will not retain billfold 16 in contact with housing 12 and billfold 16 can be removed without housing 12.

Housing 12 is provided with a shut-off switch 46 which is hidden to prevent the thief from deactivating the alarm or, if desired, a shut-off switch need not be provided.

It is to be understood that the present invention is not limited to the embodiments specifically described but include modifications which will be obvious to the person skilled in the art.

I claim:

1. A billfold anti-theft device comprising a housing, an alarm positioned within the housing, means for releasably securing a billfold to the outside of the housing and means releasably attached to said housing adapted to activate said alarm when removed from said housing.

2. The device of claim 1 wherein the means for securing the billfold to the housing comprises a spring loaded clip.

3. The device of claim 2 which includes a lever attached to said clip for releasing or securing the billfold between said clip and said housing.

4. The device of claim 1 wherein the means for activating said alarm comprises a plate having hooks adapted to be attached to clothing of the billfold owner when said billfold and housing are removed from the plate.

5. The device of claim 4 wherein said plate maintains an electrical contact open when said plate is attached to said housing.

* * * * *